US007328819B2

(12) United States Patent
Lewis

(10) Patent No.: US 7,328,819 B2
(45) Date of Patent: Feb. 12, 2008

(54) SELF-CONTAINED LIQUID DISPENSER WITH A SPRAY PUMP MECHANISM

(75) Inventor: Richard P. Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 577 days.

(21) Appl. No.: 10/950,730

(22) Filed: Sep. 27, 2004

(65) Prior Publication Data

US 2006/0071033 A1 Apr. 6, 2006

(51) Int. Cl.
*B67D 5/42* (2006.01)

(52) U.S. Cl. ..... 222/181.3; 222/321.7; 222/341; 222/494

(58) Field of Classification Search .. 222/181.1–181.3, 222/321.7, 340, 341, 383.1, 492, 494–496; 239/328, 329, 504, 518, 519, 569
See application file for complete search history.

(56) References Cited

U.S. PATENT DOCUMENTS

| | | | | |
|---|---|---|---|---|
| 3,229,863 A | | 1/1966 | Scoggin, Jr. et al. | |
| 4,360,130 A | * | 11/1982 | Nishimura et al. | 222/153.09 |
| 4,561,571 A | * | 12/1985 | Chen | 222/207 |
| 4,949,877 A | | 8/1990 | Hanna et al. | |
| 4,978,036 A | * | 12/1990 | Burd | 222/207 |
| 4,982,900 A | | 1/1991 | Blake | |
| 4,991,746 A | | 2/1991 | Schultz | |
| 5,439,178 A | | 8/1995 | Peterson | |
| 5,881,956 A | | 3/1999 | Cohen et al. | |
| 5,908,143 A | | 6/1999 | Crossdale et al. | |
| 6,401,972 B1 | | 6/2002 | Schlattl et al. | |
| 6,422,434 B1 | | 7/2002 | Lammond Wass et al. | |
| 6,516,976 B2 | | 2/2003 | Lewis et al. | |
| 6,533,145 B2 | | 3/2003 | Lewis et al. | |
| RE38,077 E | | 4/2003 | Cohen et al. | |
| 6,543,651 B2 | | 4/2003 | Lewis et al. | |
| 6,575,334 B2 | | 6/2003 | Lewis et al. | |
| 6,575,335 B2 | | 6/2003 | Lewis et al. | |
| 6,648,179 B2 | | 11/2003 | Lewis et al. | |
| 6,729,502 B2 | | 5/2004 | Lewis et al. | |
| 2002/0125271 A1 | * | 9/2002 | Zeitlin | 222/181.3 |
| 2002/0139816 A1 | * | 10/2002 | Powling | 222/341 |

FOREIGN PATENT DOCUMENTS

GB 2394941 5/2004

OTHER PUBLICATIONS

PCT Search Report, Aug. 31, 2005.

* cited by examiner

*Primary Examiner*—Joseph A. Kaufman
(74) *Attorney, Agent, or Firm*—Dority & Manning

(57) ABSTRACT

A self-contained viscous liquid dispenser with a spray pump mechanism includes a housing defining an internal liquid reservoir. A spray pump mechanism is configured with the housing and includes a horizontally disposed pump chamber fitted through an opening in the housing to extend into the reservoir. A pump cylinder is slidably disposed and retained in the chamber. Upon actuation of the pump cylinder, a valve and spray forming mechanism converts a liquid stream expelled from the pump chamber into a spray.

22 Claims, 9 Drawing Sheets

SELF-CONTAINED LIQUID DISPENSER WITH A SPRAY PUMP MECHANISM

FIELD OF THE INVENTION

The present invention relates to the field of liquid dispensers, and particularly to a liquid dispenser having a spray pump mechanism.

BACKGROUND OF THE INVENTION

Various configurations and models of liquid dispensers, particularly liquid soap dispensers, are well known in the art. Conventional dispensers employed in public restrooms and the like are wall mounted units that typically include a housing or other structure that is permanently affixed to a wall. These dispensers usually include an access door or member so that the dispenser can be opened by a maintenance person for refilling or servicing. With certain types of dispensers, separate refill cartridges are inserted into the housing structure. With other types of dispensers, the maintenance technician must directly refill a reservoir provided in the housing structure. The dispensers typically include a delivery device, such as a dosing pump, and a device such as a lever or button for actuating the dosing pump. The dispensers may be vented or unvented.

Improved dispensers particularly suited for use as soap dispensers are described in detail in the following U.S. Pat. Nos.: 6,516,976; 6,533,145; 6,543,651; 6,575,334; and 6,575,335.

In various environments and uses of dispensers, it is often desirable to convert and dispense the liquid stored in a dispenser as a spray of droplets or mist, particularly if the liquid is of a less viscous nature and well suited for dispersion in a spray pattern. A spray may be preferred by the consumer for various reasons. Also, less of the liquid is needed per metered dose as compared to a steady stream of the liquid, thus extending the time between refill or replacement of the dispenser.

Spray pumps and bottles are known in the art for dispensing liquid stored in a reservoir in the form of a spray. Reference is made, for example to U.S. Pat. Nos. 4,982,900 and 5,881,956. For various reasons, however, spray pump mechanisms have not been widely used or incorporated with relatively large volume dispensers of the type preferred for use in public restrooms, and the like.

The present invention provides a relatively large volume dispenser of the type typically used in public restroom facilities that incorporates a novel spray pump mechanism.

OBJECTS AND SUMMARY OF THE INVENTION

Objects and advantages of the invention will be set forth in part in the following description, or may be obvious from the description, or may be learned through practice of the invention.

The present invention provides a self-contained liquid dispenser incorporating a spray pump mechanism. Although having particular usefulness as a liquid soap dispenser, the dispenser according to the invention is not limited to a liquid soap dispenser and may be utilized in any application wherein it is desired to dispense metered doses of a liquid in the form of a spray. The liquid dispenser will be described herein with reference to a soap dispenser for ease of explanation.

The liquid dispenser includes a housing that may be formed of any suitable material. For example, the housing may be molded from relatively inexpensive plastic materials and may have any desired aesthetic shape. The housing also defines an internal liquid reservoir. In other words, the liquid reservoir is not a separate component from the housing, such as a cartridge or the like. The housing may be comprised of wall members that give the dispenser its outward appearance and also define the internal liquid reservoir.

A spray pump mechanism is disposed at least partially within the reservoir. The pump mechanism has a delivery end that extends out of the reservoir and is actuated by a user to dispense the liquid. In a particular embodiment, the spray pump mechanism includes a pump chamber that extends into the reservoir and has a back end open to the reservoir. The pump chamber may be defined within the dispenser housing. For example, the pump chamber may comprise an integrally molded component of the housing. In an alternate embodiment, the pump chamber may be defined by an insert member that is fitted into an opening in the front of the housing. A siphon tube may be attached to the back end of the pump chamber and be oriented towards the bottom of the reservoir to ensure that as much liquid as possible is dispensed from the reservoir in a vertical orientation of the housing. It should be appreciated that any number of configurations may be utilized to define a pump chamber that is in fluid communication with a liquid reservoir. A number of suitable configurations are described and shown, for example, in U.S. Pat. Nos. 6,516,976 and 6,729,502, which are incorporated herein by reference in their entirety for all purposes.

A pump cylinder is slidably disposed and retained in the pump chamber and includes a delivery end that extends out of the pump chamber and a delivery channel defined therethrough. The pump cylinder is movable within the pump chamber from a rest position to a pressurizing position, and may be biased to the rest position. An actuator is configured with the pump cylinder and provides a device for an operator to move the pump cylinder to its pressurizing position in order to dispense the liquid. The pump cylinder may resemble a shaft and piston device that sealably slides within the pump chamber. Upon movement of the cylinder within the pump chamber, any liquid contained within the chamber is pressurized and ultimately dispensed out of the chamber, for example through the delivery channel defined through the pump cylinder. Upon movement of the pump cylinder from the pressurizing position back to the rest position, a metered amount of the liquid within the reservoir is siphoned into the pump chamber through the back of the chamber, for example through a siphon tube.

The pump cylinder can take on various configurations. For example, in one embodiment, the pump cylinder is a unitary member that is fitted into the pump chamber through the back end of the chamber, and has a delivery channel defined longitudinally therethrough. In an alternate embodiment, the pump cylinder includes a first component having a first channel defined therethrough, and a second component fitted into the first component with a respective second channel that axially aligns with the first channel, the first and second channels defining a delivery channel through the pump cylinder. Seals may be provided on the first and second components that slide along the inner wall of the pump chamber. An example of this type of pump cylinder is described in U.S. Pat. No. 6,729,502 incorporated herein.

A valve mechanism is disposed in the delivery end of the pump cylinder. The valve mechanism is a generally resilient member that opens or moves upon sufficient liquid pressure build-up within the pump chamber. For example, the valve may be a bifurcating valve having a plurality of flexible flap members that define an opening therethrough in an open configuration of the valve. In a closed configuration of the valve, the flap members seal against each other. Upon release of the pump cylinder, the flaps may also be drawn slightly inward due to the vacuum created in the pump chamber and, thus, define a vent path into the chamber through the delivery end of the pump cylinder. Thus, it is not necessary to separately vent the pump chamber, for example around the pump cylinder. This inward draw, or "suck back" feature, may also serve to draw any residual liquid back into pump cylinder to prevent dripping or clogging. Once the pump cylinder reaches its rest position, the flaps close to completely seal the dispensing orifice and, thus, prevent leakage or drippage from the dispensing orifice.

The dispenser also includes a spray forming mechanism disposed downstream of the valve mechanism to contact and convert a stream of relatively high velocity liquid forced through the valve mechanism upon actuation of the actuator into a spray pattern. In a particular embodiment, the spay forming mechanism includes a chamber into which liquid from the valve mechanism is directed. An exit orifice is defined in the chamber through which the liquid is expelled. The chamber may have a converging configuration (in the direction of liquid flow) with the exit orifice defined at the apex thereof. An impact member is disposed in-line with and downstream of the exit orifice such that the liquid is directed against the impact member. The impact member has a shape that causes the relatively high velocity liquid stream from the exit orifice to break up into a spray pattern.

In a particular embodiment, a spray forming chamber is defined generally around the impact member. This forming chamber is shaped so as to focus and direct the spray reflected from the impact member in an exit direction out of the delivery end of the pump mechanism. For example, the impact member may be an essentially cylindrical member having an end disposed across from the exit orifice. The cylindrical member may be disposed in a generally cylindrical chamber that serves as the spray forming chamber.

The spray forming mechanism may also include restraining structure disposed radially inward of the point of flexure of the resilient flaps of the valve mechanism to contact and limit the degree of flexure of the flap members. In a particular embodiment, the restraining structure may be a generally cylindrical wall that extends into the valve radially inward of a circumferential wall of the valve. The cylindrical wall has an end that is disposed adjacent the flaps and thus limits the degree of opening movement of the flap members upon actuating the pump cylinder. This configuration ensures that the flaps do not completely open and that the liquid pushed through the valve upon pressurization of the pump chamber is maintained at a sufficient pressure and velocity to be converted into a spray. The cylindrical wall may also define the chamber disposed downstream of the valve, as discussed above.

In a particular embodiment, the restraining structure is defined within a retaining member that attaches to the delivery end of the pump cylinder. This retaining member also serves to retain the valve mechanism within the delivery end of the pump cylinder. The impact member be separately attachable to the retaining member.

The dispenser also includes an actuator configured with the delivery end of the pump cylinder for a user to move the pump cylinder from its rest position to the pressurizing position. The actuator may be any aesthetically pleasing mechanism that engages with the delivery end of the pump cylinder, for example via a nozzle pressed onto the pump cylinder, to move the cylinder upon the user pressing the actuator.

The dispenser may also include a mounting mechanism that may be configured as an integral component of the housing. The mounting mechanism allows the dispenser to be detachably connected to complimentary mounting structure on a wall surface. In this way, the dispenser may be easily removed from the wall surface for disposal or recycling once the liquid has been depleted. A new or replacement dispenser according to the invention may then be attached to the wall surface.

A vent path is defined into the reservoir to prevent drawing a vacuum therein. In a particularly desired embodiment, the vent is provided in a top surface of the housing structure. Since the housing structure is mounted in use upon a wall surface, there is little concern of the liquid leaking from the vent in the top surface. In other embodiments, the reservoir may be vented through the pump mechanism. However, venting through the pump mechanism may result in undesired leakage through the mechanism, particularly if the pump mechanism is disposed in the lower portion of the housing. Venting may also be accomplished through the valve mechanism in the delivery end of the pump cylinder, as mentioned above.

It should be appreciated that the configuration and appearance of the housing is not a limiting feature of the invention. Also, the invention is not limited to the use of any particular type of materials or manufacturing process. Various embodiments of interlocking engagement structure between the back side of the housing and the wall mounting member are also within the scope and spirit of the invention. For example, the engaging structure may include bayonet type fasteners, or the like.

The invention will be described in greater detail below with reference to particular embodiments illustrated in the figures.

DETAILED DESCRIPTION

Figure 1:
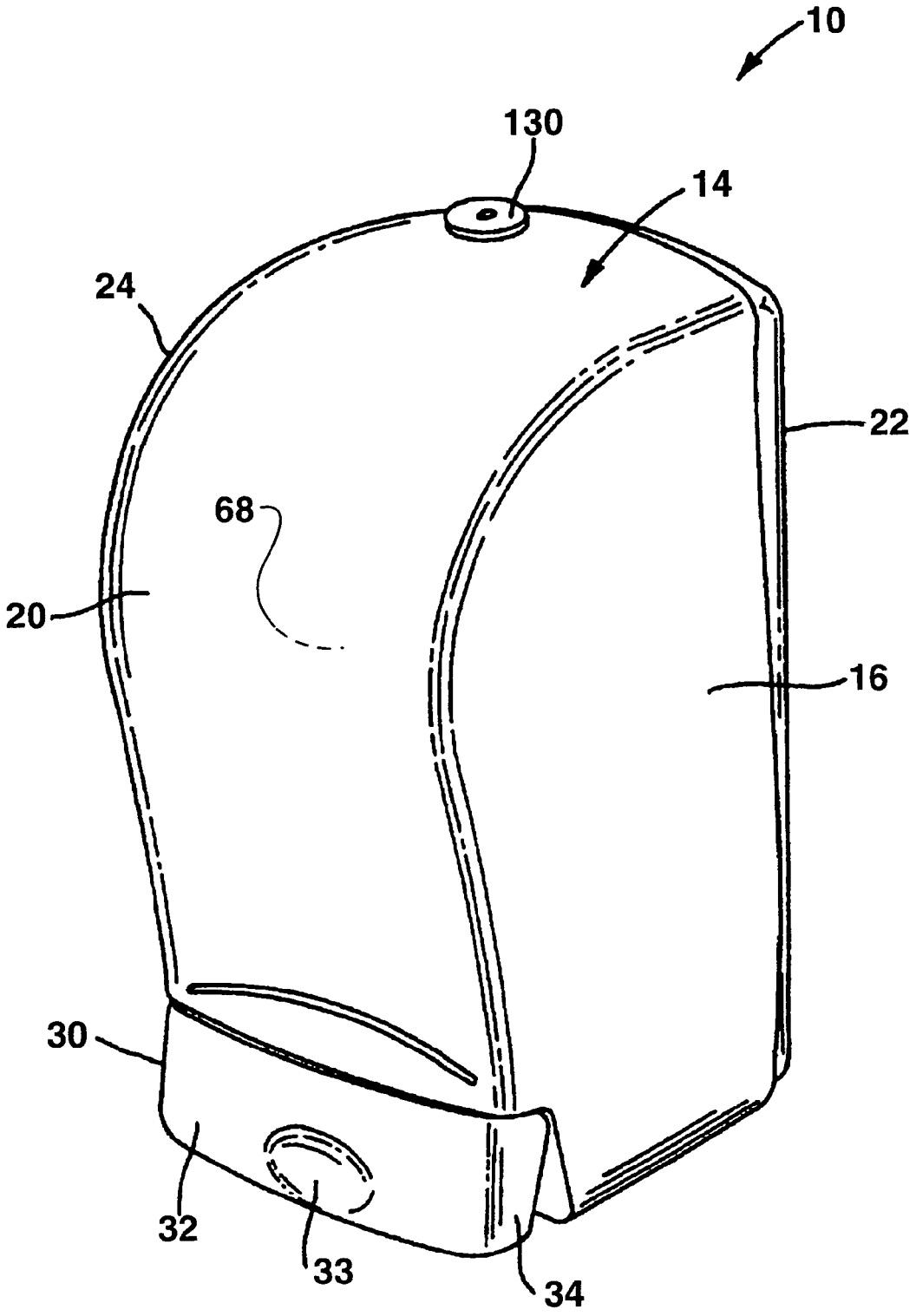
FIG. 1 is a perspective view of a dispenser according to the present invention.
Figure 2:
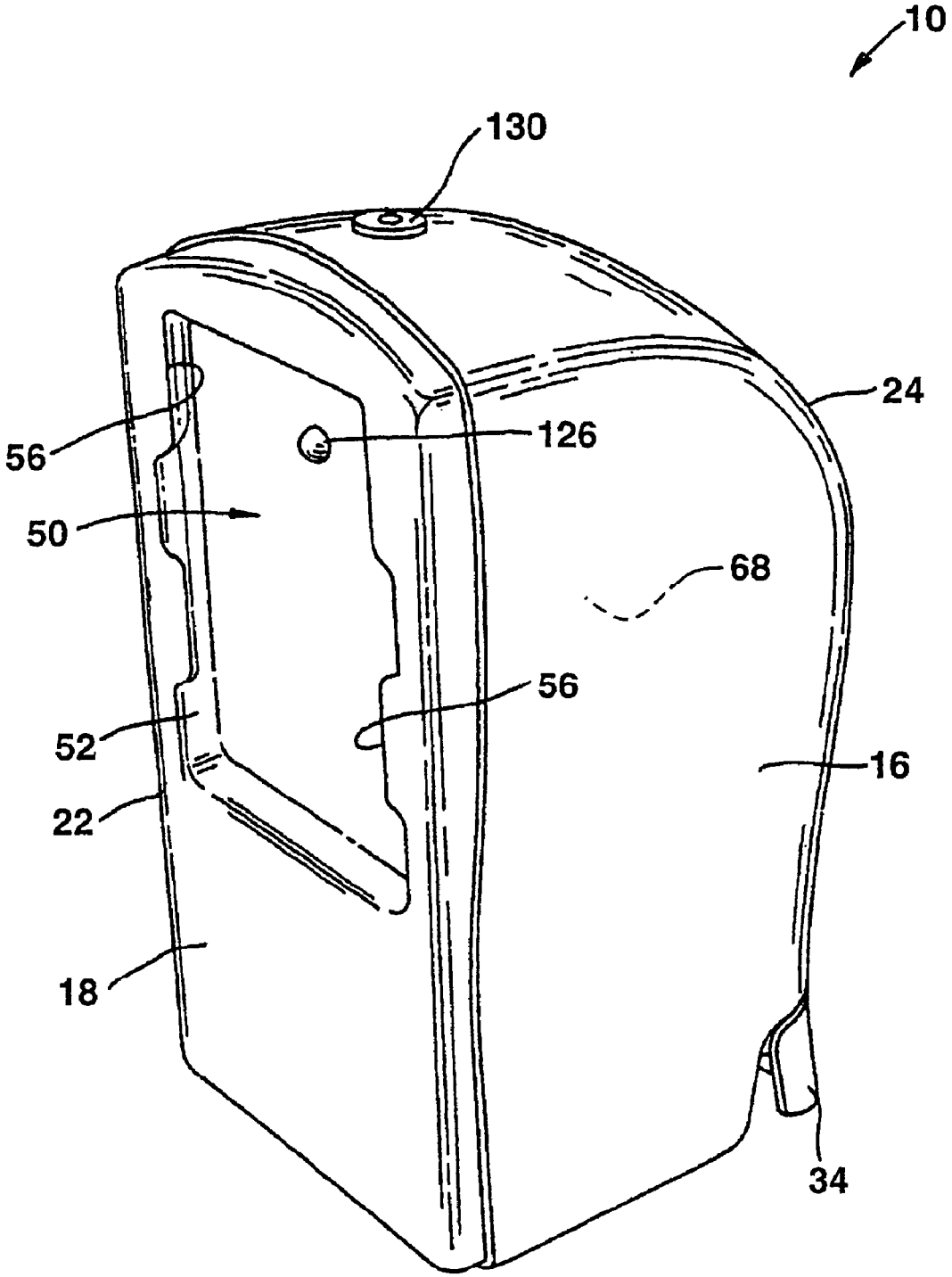
FIG. 2 is a back perspective view of the dispenser illustrated in FIG. 1.

Reference will now be made in detail to embodiments of the invention, one or more examples of which are illustrated in the drawings. Each example is provided by way of explanation of the invention, and not meant as a limitation of the invention. For example, features illustrated or described as part of one embodiment, may be used with another embodiment, to yield still a further embodiment. It is intended that the present invention include modifications and variations to the embodiments described herein.

A dispenser 10 with a spray pump mechanism according to the invention is illustrated generally in the figures. The dispenser 10 is illustrated and described herein as a liquid soap dispenser, which is a particularly useful embodiment of the present invention. However, it should be appreciated that the present invention is not limited to a dispenser for liquid soap, but has application in any environment wherein it is desired to dispense a metered amount of a viscous liquid from a dispensing unit as a spray.

Various aspects of the dispenser 10 are described in the commonly owned U.S. Pat. Nos. 6,533,145; 6,543,651; 6,575,334; 6,575,335; and 6,729,502 cited above. These patents are incorporated herein by reference in their entirety for all purposes.

Figure 3:
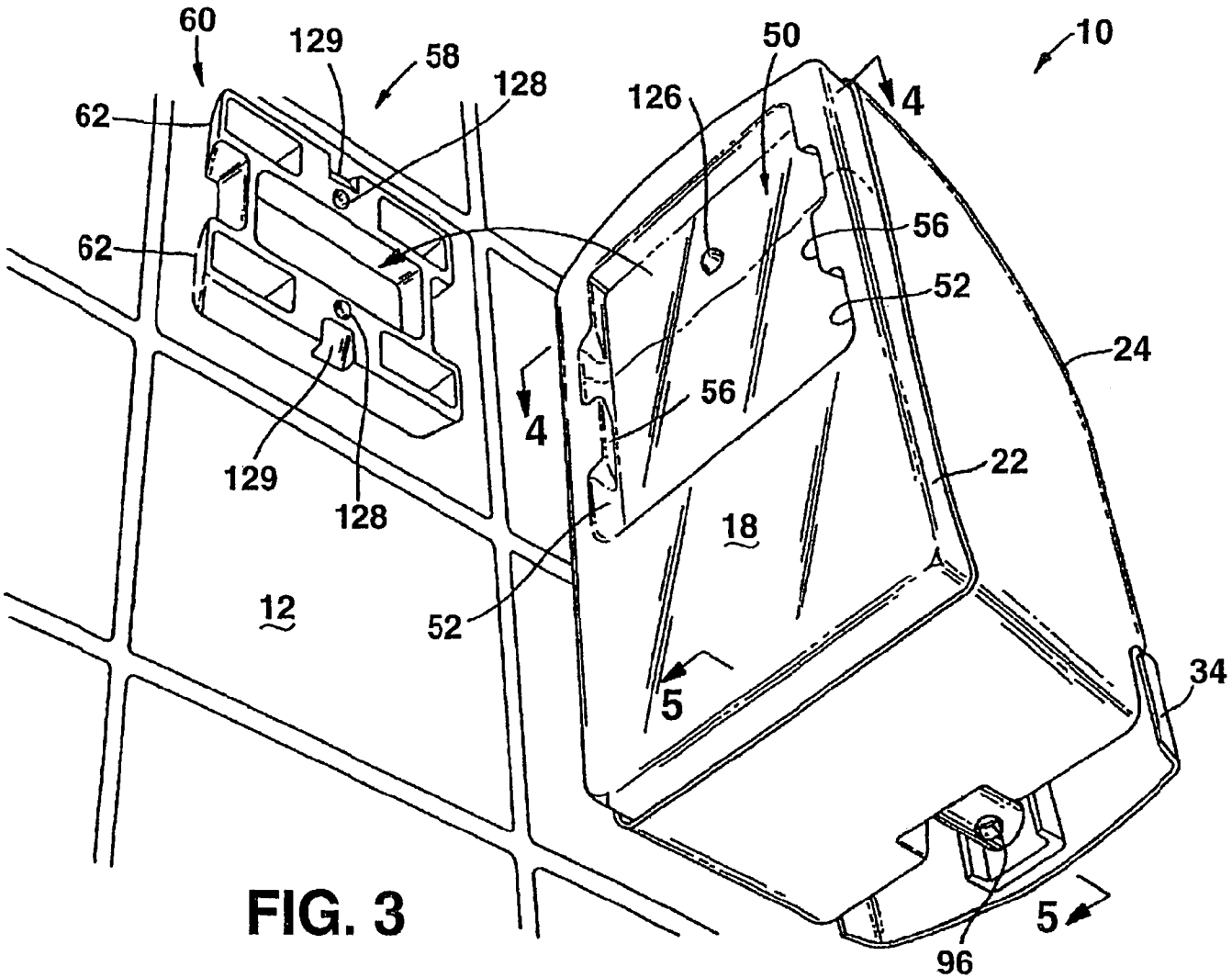
FIG. 3 is an alternative perspective view of the dispenser according to FIG. 1 and complimentary wall mounting structure.
Figure 4:
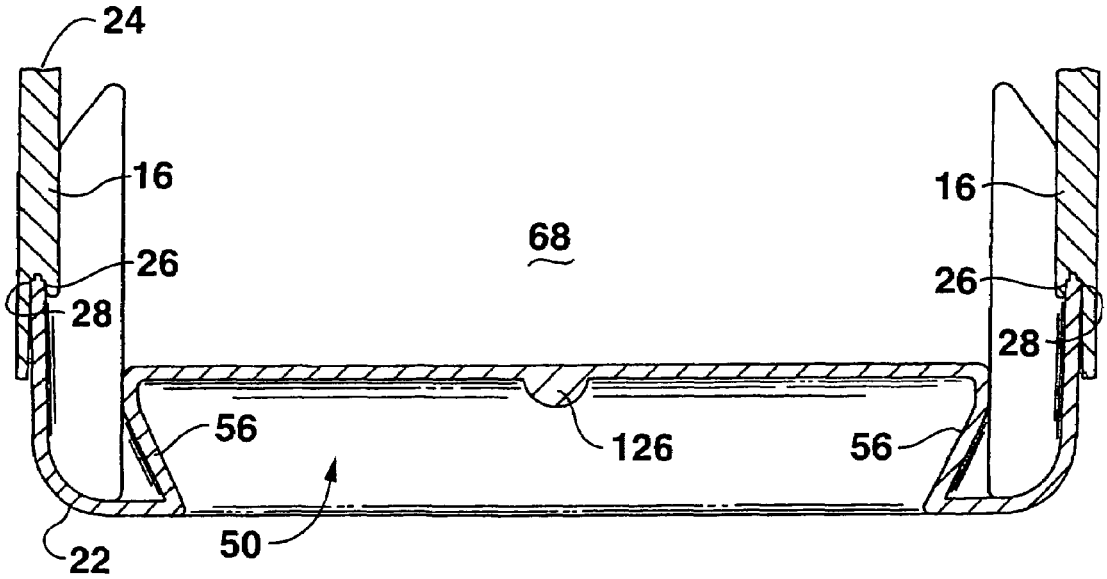
FIG. 4 is a cross-sectional view of the dispenser taken along the lines indicated in FIG. 3.

Referring to FIGS. 1-4 in general, the dispenser 10 includes a housing, generally 14. The housing 14 may contain side walls or members 16, a back side 18, and a front side 20. The housing 14 can take on any desired configuration and be formed from any number of components. In the illustrated embodiment, the housing 14 includes a front component 24 and a back component 22. The front and back components are separately manufactured and are permanently joined. It should be appreciated that the components may be manufactured from any desired material. In a preferred embodiment, the dispenser 10 is a disposable item and the housing 14 is molded from a relatively inexpensive plastic material. Referring particularly to FIG. 4, the back component 22 may be molded from a clear or translucent plastic and includes side edges 26 and alignment tabs (not visible) that align the back component 22 relative to the front component 24. The side edges 26 fit into correspondingly sized recesses 28 defined in the side walls 16 of the front component 24. The back component 22 is permanently joined to the front component 24 by adhesives, welding, or any other relatively permanent attaching means.

The housing 14 defines an internal liquid reservoir 68 within the internal volume thereof. In the illustrated embodiment, the liquid reservoir 68 includes essentially the entire volume defined by the front component 24 and back component 22. Although not illustrated, it should be understood that any number of internal structural members, such as baffles or the like, may be included within the reservoir 68. It should be understood that the housing 14 thus also serves as a closed or sealed reservoir and the dispenser 10 cannot be opened by the maintenance technician. A desired amount of viscous liquid, for example soap, is preloaded into the dispenser 10 prior to the dispenser being delivered to its point of use.

Figure 5:
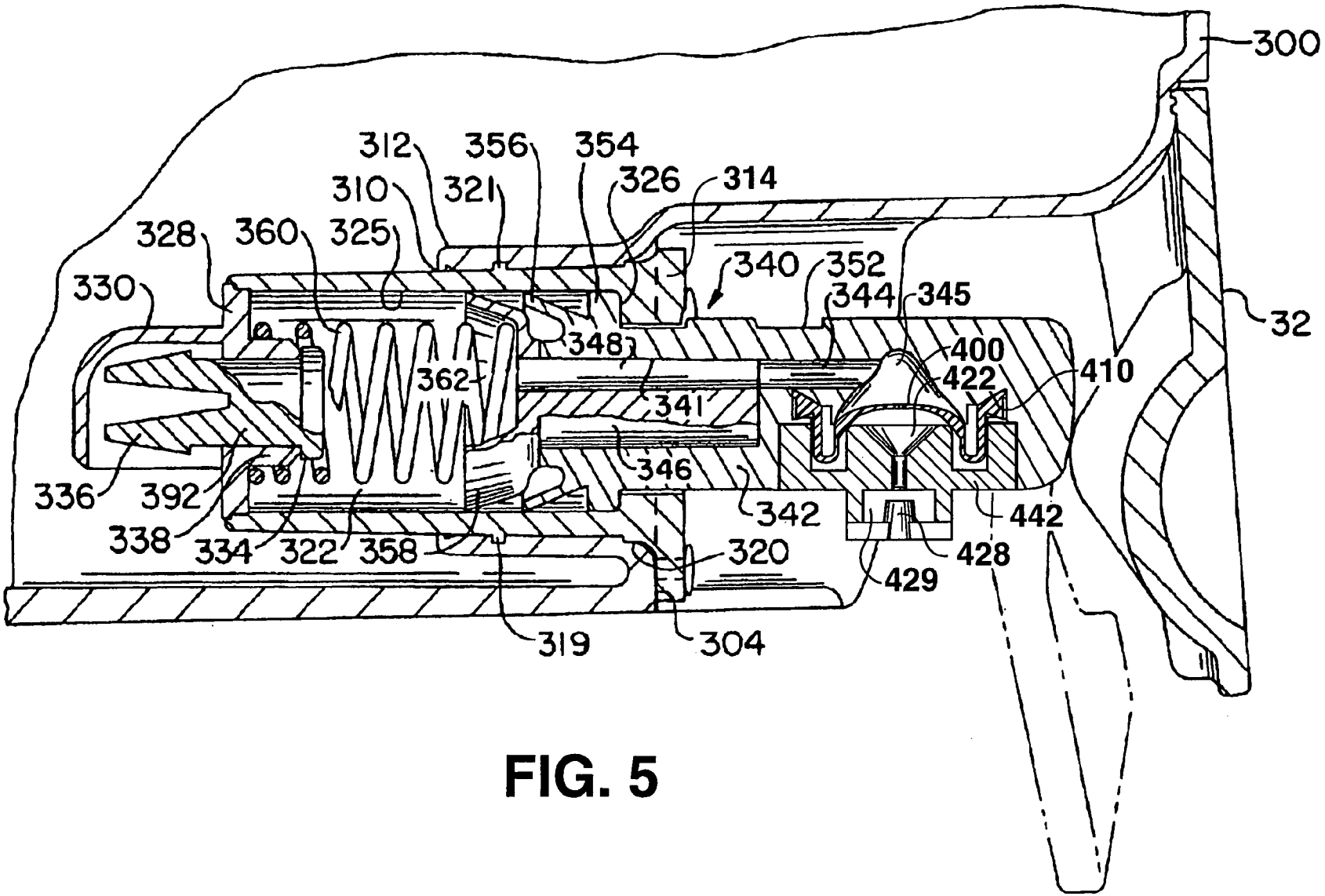
FIG. 5 is a cross-sectional view of a suitable pump mechanism of the dispenser taken along the lines indicated in FIG. 3.

An embodiment of a spray forming pump mechanism that may be used with the dispenser 10 according to the invention is illustrated particularly in FIGS. 5 through 10. This pump mechanism is similar in many respects to the mechanism according to an embodiment of commonly owned U.S. Pat. No. 6,729,502 incorporated herein by reference for all purposes. Referring to FIG. 5, in this embodiment the housing 300 includes a bore (bore 302 in FIG. 10) defined through a front surface 304. A generally cylindrical extension 312 may extend rearwardly from the front surface 304 into the reservoir. The extreme end of the cylinder extension 312 has a radially inward extending seal 310. As will be described in greater detail below, seal 310 seals against a chamber insert member. A circumferential recess or groove 319 may also be defined in the extension 312. A plurality of nubs or protrusions 308 extend from the front surface 304 and surround the bore 302. The cylindrical extension 312, ring seal 310, groove 319, and protrusions 308 may all be molded integrally with housing 300.

Figure 10:
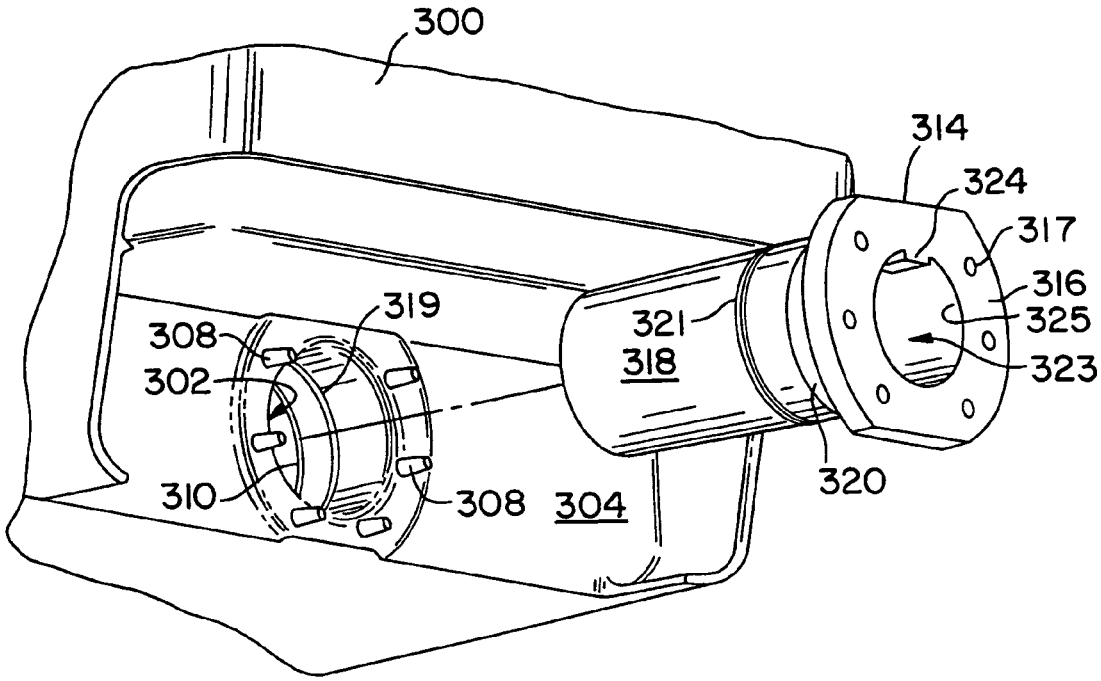
FIG. 10 is a component view of a pump insert from one suitable embodiment of a pump mechanism for use with the invention.

Referring to FIG. 10, a chamber insert 314 is designed to fit through the bore 302 in the housing surface 304. The insert 314 may be a generally cylindrical member having an interior wall 325 defining an internal pump chamber 322. An opening 323 is defined through the forward end of the insert 314 through which a pump cylinder slides, as described below. The insert 314 includes a front outer flange 316 having a plurality of counter-bored holes 317 defined therethrough. The holes 317 align with the protrusions 308. The insert 314 is fitted through the bore 302 from the front side of the housing 300. The back side of the flange 316 is pressed against the front surface 304 of the housing 300 and the protrusions 308 extend through the holes 317. The insert is permanently attached to the housing 300 by melting the protrusions 308 in a "heat stake" process so that the molten material flows into the counter-bored holes 317 and thus anchors the insert 314 upon hardening. It should be appreciated that many other suitable devices and methods could be used to anchor or secure the insert 314 relative to the housing 300, including adhesives, welding, etc.

The insert 314 has an outer circumferential surface 318 that, when slid through the bore 302 and cylindrical extension 312, is tightly engaged by the seal 310 at the end of the extension 312. Thus, a first seal between the insert 314 and housing 14 is formed in this way. A ring-like protrusion 321 may be formed or otherwise provided around the surface 318 which engages in the groove 319 to give a positive indication that the insert 314 has been properly inserted. The ring 321 may be an O-ring and thus also provide a sealing capacity.

The insert 314 includes a radially outward extending portion 320 defined rearward of the back side of the outer flange 316. This portion 320 acts as a seal against the cylindrical extension 312, as particularly seen in FIG. 5. Thus, a second seal between the insert 314 and housing 24 is formed in this way.

The insert 314 includes an inner flange 326 defining the diameter of the opening 323, and an alignment tab 324 formed in the chamber 322. This tab 324 cooperates with a longitudinally extending channel or groove defined in the pump cylinder, as described below.

It should be appreciated that the embodiment of a pump chamber defined by insert member 314 is but one of any number of ways to define a pump chamber. For example, the pump chamber may be an integrally formed chamber as described with respect to FIGS. 5 through 7 of U.S. Pat. No. 6,729,502 incorporated herein by reference.

A pump cylinder is slidably disposed and retained in the pump chamber 322. The pump cylinder may be a single component defining a delivery channel therethrough, as in the embodiment of FIGS. 5 through 7 of U.S. Pat. No. 6,729,502. In an alternate embodiment depicted in FIG. 5 of the present application, the pump cylinder is multi-component device. This embodiment includes a two-part pump cylinder 340. The first component 342 is a generally cylindrical member having a channel 344 defined therethrough that terminates at a dispensing orifice 96 (FIG. 3) defined in the front end of the first component 342. The front end of the first component 342 thus corresponds to the delivery end of the pump cylinder 340. A flange 354 is provided at the rearward end of the first component 342 to prevent the pump cylinder 340 from being pulled out of the pump chamber 322. This flange 354 engages against the inner flange 326 of the insert 314 in the fully extended position of the pump cylinder 340, as illustrated in FIG. 5.

A locking feature is provided for the pump cylinder 340. A longitudinal groove or channel (not visible in FIG. 5) is defined along the top outer surface of the first component 342 and is engaged by the alignment tab 324 of the insert 314 (FIG. 10) as the cylinder is slid longitudinally within the pump chamber 322. In this way, the pump cylinder 340 is prevented from rotating upon actuation and release thereof. A partial circumferential groove 352 is defined in the outer surface of the first component 342, as particularly illustrated in FIG. 5. The circumferential groove 352 is defined at a location corresponding to the pressurization position of the pump cylinder 340 within the pump chamber 322. For shipment of the dispenser, the pump cylinder 340 may be depressed and then rotated so that the tab 324 is engaged within the circumferential groove 352. In this configuration, the pump cylinder 340 is locked in the pressurization position and cannot move within the pump chamber 322 until the pump cylinder is rotated back into position so that the tab 324 is engaged within the longitudinal groove.

The first component 342 of the pump cylinder 340 also includes a flange seal 356 defined at the rearward end thereof. The flange seal 356 engages against the interior wall 325 of the insert 314 and ensures that the viscous liquid contained within the chamber 322 is pressurized and dispensed through the pump cylinder 340 upon movement of the cylinder from its rest position to the pressurization position and does not simply move from one end of the pump chamber to the other upon movement of the cylinder.

The second component of the pump cylinder 340 may be a plug member 346 having a generally cylindrical extension that is fitted into a chamber 341 defined in the rearward end of the first component 342. The plug member 346 has a channel 348 defined therethrough that axially aligns with the channel 344 defined in the first component 342. The aligned channels 344 and 348 thus define the delivery channel through the pump cylinder 340. As shown in FIG. 5, the channel 348 may be open along the top thereof wherein a closed channel is formed by cooperation of the first component wall defining the chamber 341 and the open channel 348. A cup-shaped flange member 358 is defined at the rearward end of the plug member 346. The side wall of the flange member 358 engages against the interior wall 325 of the insert 314 and thus defines a second flange seal between the pump cylinder 340 and the pump chamber 322. The interior of the cup-shaped flange member 358 defines a recess or seat 362 against which a spring sits, as described below.

A check valve is provided with the pump chamber 322 to ensure that the liquid within the chamber 322 is not pushed out of the chamber upon movement of the pump cylinder 340 within the chamber. The check valve in this embodiment is a shuttle valve 392 having radially extending and spaced apart arms 336. The shuttle valve 392 is slidably disposed within an opening defined through an end cap 328. The space between the radial arms 336 is open to the reservoir so that liquid can flow from the reservoir into the pump chamber 322 upon movement of the pump cylinder 340 to the forward end of the pump chamber 322. A sealing cap 334, such as an elastomeric cap, is provided on the forward end of the shuttle valve 392 to ensure that the opening in the end cap 328 is sealed upon actuation of the pump and rearward movement of the pump cylinder 340 within the chamber 322 to its pressurization position. The cap 334 seals against the forward end of a cylindrical extension 338 of the end cap 328. An open cage member 330 extends from the end cap 328 into the reservoir and surrounds the radial arms 336.

The pump cylinder 340 is biased with the pump chamber 322 to its rest position by way of a spring 360. Other types of resilient devices, such as a leaf spring, spring washer, and the like, may be utilized for this purpose. The spring 360 has a forward end seated in the recess 362 of the cup-shaped flange member 358 of the plug member 346. The opposite end of the spring 360 is fitted around the cylindrical extension 338 of the end cap 328.

The end cap 328 is permanently fixed (i.e., by welding, adhesive, etc.) to the rearward end of the chamber insert 314 after the pump cylinder 340 and spring 360 are inserted into the insert from its rearward end.

The pump mechanism of FIG. 5 may be desirable from a manufacturing and assembly standpoint. It may also be desirable to be able to remove the pump mechanism from the housing and recycle or reuse all or part of the pump mechanism. In this case, it might be preferred to provide a more readily "breakable" or disconnectable attachment between the chamber insert 314 and the housing 300, such as a releasable adhesive, mechanical fastener (i.e., threaded connection), etc. Although within the scope and spirit of the invention, with the embodiment of FIGS. 5 and 10, it might prove prohibitive to break the heat stake welds between the chamber insert 314 and front surface 304 of the housing 300 to remove the insert 314.

Figure 6:
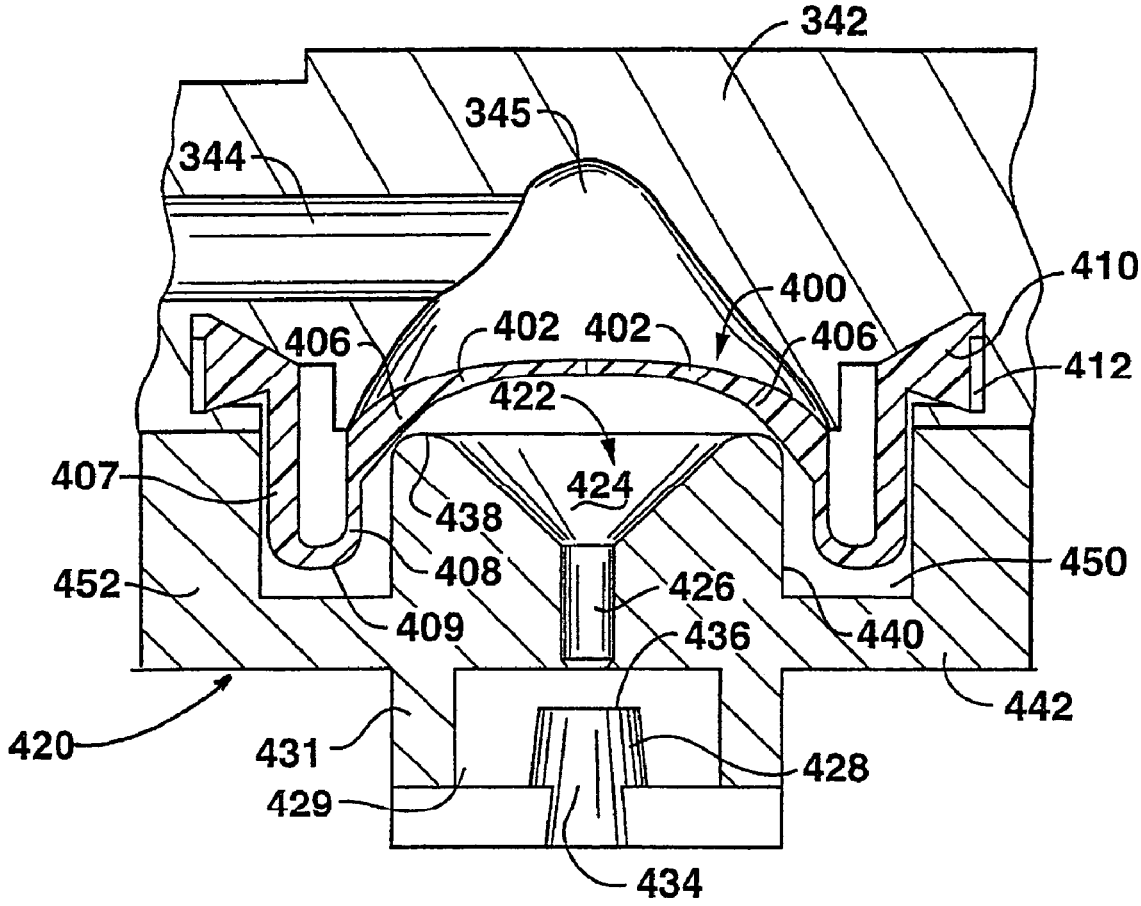
FIG. 6 is a detailed cross-sectional view of an embodiment of a suitable spray forming mechanism in the delivery end of the pump cylinder.
Figure 7:
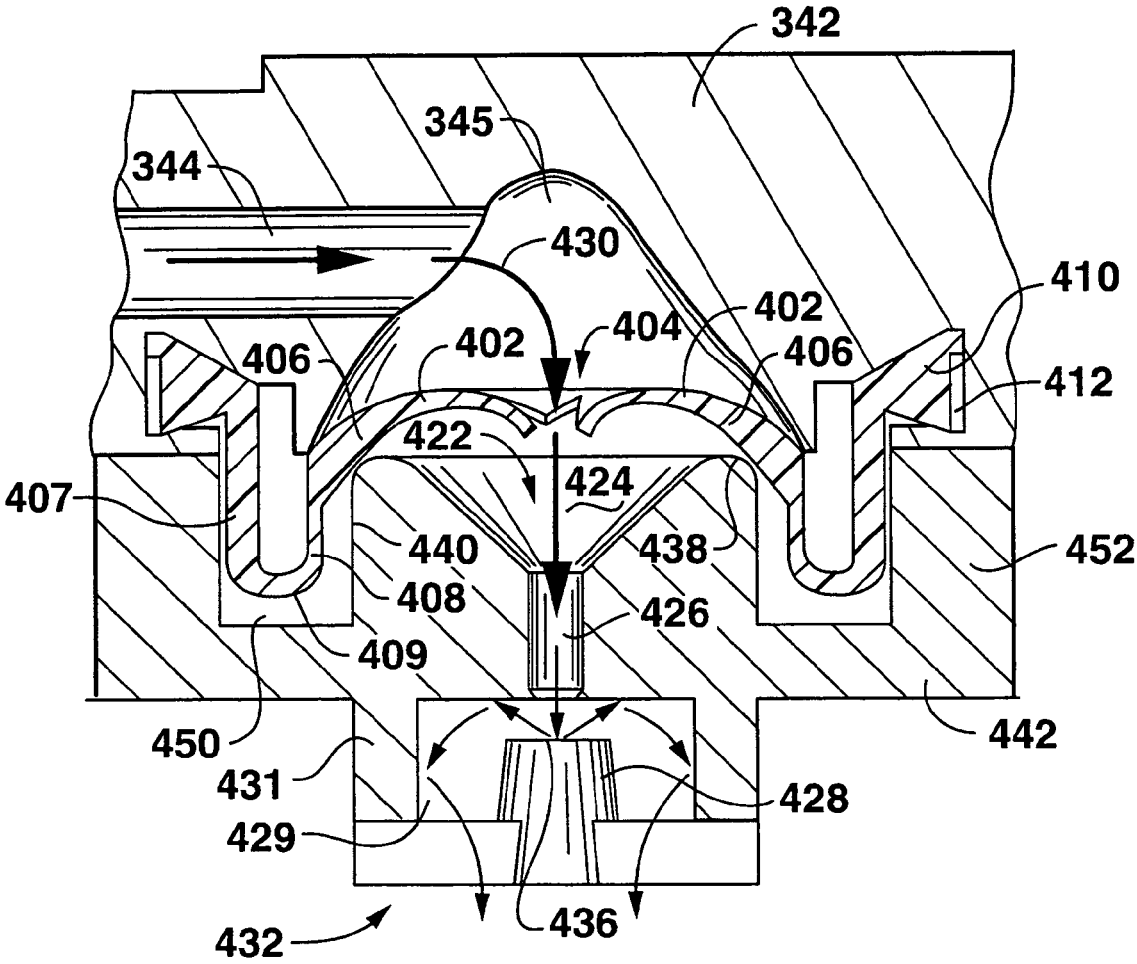
FIG. 7 is an operational view of the spray forming mechanism of FIG. 6.
Figure 8:
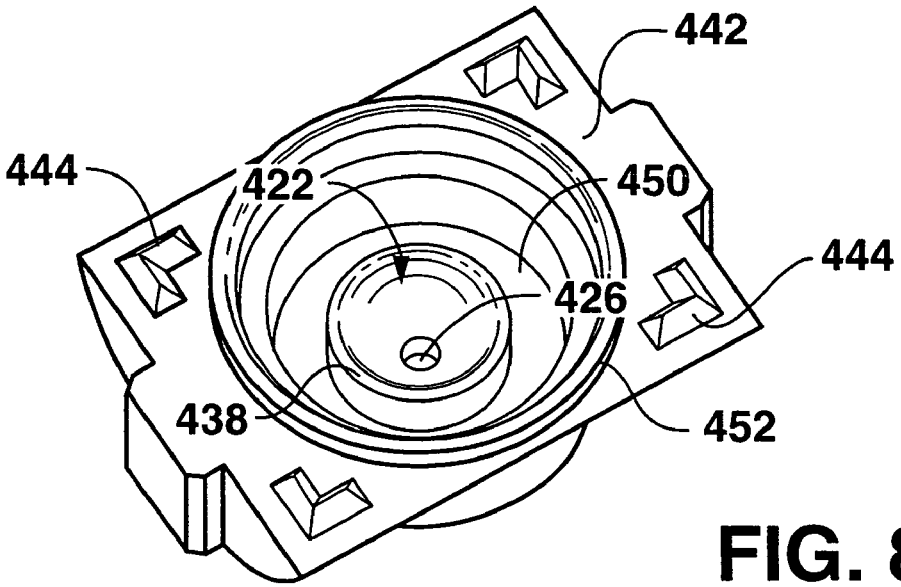
FIG. 8 is a component view of the valve retaining member.
Figure 9:
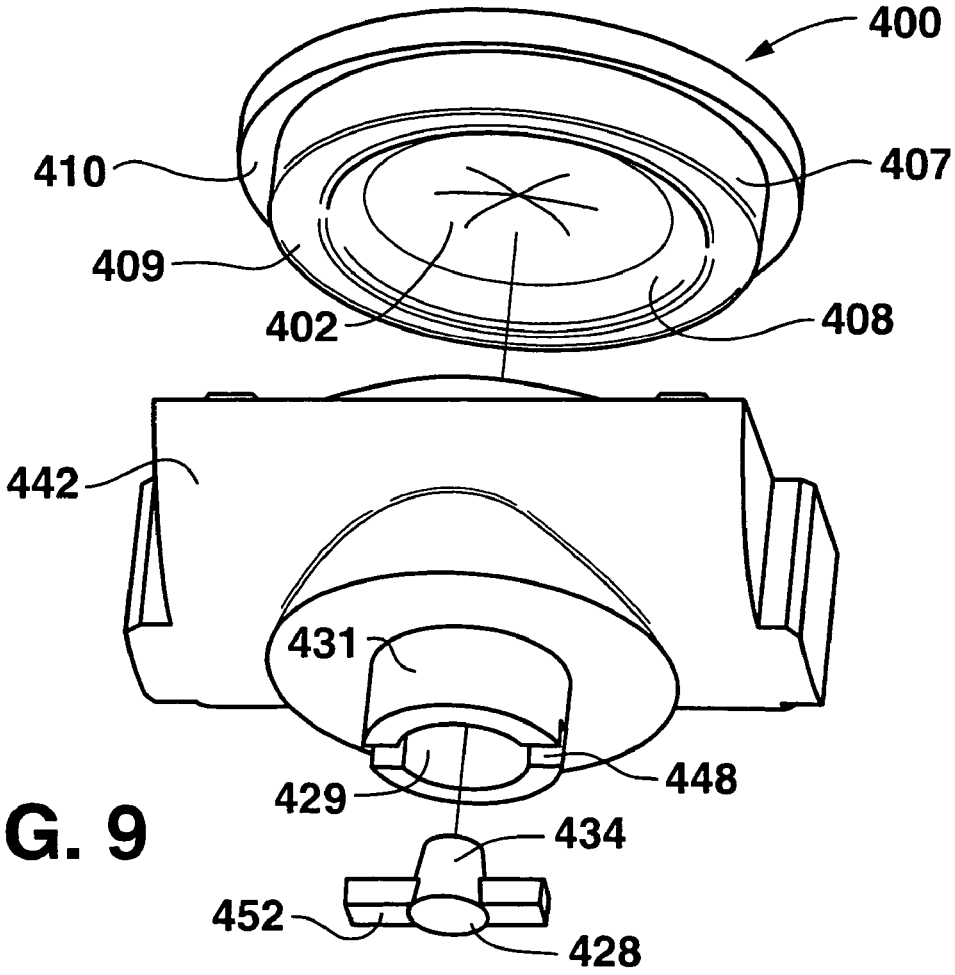
FIG. 9 is a component view of the spray forming mechanism of FIGS. 6 and 7.

Referring particularly to FIGS. 5 through 9, a valve mechanism 400 is disposed in the delivery end of the pump cylinder 340. Fluid from the pump chamber 322 is directed along the delivery channel 344 and directed to a chamber 345 defined in the first component 342 of the pump cylinder 340 above the valve mechanism 400. A particularly useful valve mechanism 400 is the bifurcating valve illustrated in the figures. This valve 400 includes a flange member 410 extending radially from an outer circumferential wall 407 into a groove 412 to seat the valve 400 within the delivery end of the pump cylinder 340. A plurality of flexible flap members 402 extend radially from an inner circumferential wall 408 that is separated from the outer wall 407 by a U-shaped turn 409. The flap members 402 define an opening 404 (FIG. 7) therethrough in an open configuration of the valve 400, and seal against each other in the closed configuration of the valve 400 as illustrated in FIGS. 5 and 6. Upon actuation of the pump cylinder 340, liquid pressure within the chamber 345 forces the resilient flap members 402 to open and dispense liquid through the opening 404, as illustrated in FIG. 7.

Upon release of the pump cylinder 340, the flap members 402 tend to vent the pump chamber 322 as the pump cylinder 340 returns to its rest position. As a vacuum is drawn in the chamber 322, the flap members 402 separate slightly and are drawn slightly inward due to the vacuum created in the pump chamber 322 and, thus, a vent path into the chamber 322 is defined through the delivery end of the pump cylinder 340. Once pressure in the chamber 322 is equalized, the flap members 402 close and seal against each other thereby sealing the dispensing orifice and preventing leakage or drippage from the pump cylinder 340.

The valve 400 illustrated in the figures is conventionally known in the art as a bifurcating valve and may be obtained from LMS Corporation of Michigan, USA.

The dispenser 10 also includes a spray forming mechanism, generally 420, disposed downstream of the valve mechanism 400 to contact and convert a stream 430 of relatively high velocity liquid forced through the valve mechanism 400 into a spray pattern 432, as depicted in FIG. 7. In a particular embodiment, the spay forming mechanism 420 includes a chamber 422 into which liquid from the valve mechanism 400 is directed. This chamber 422 may take on various shapes and configurations. In the illustrated embodiment, the chamber 422 has a converging shape (in the direction of liquid flow) defined by conical wall 424. An exit orifice 426 is defined at the apex of the chamber 422 through which the liquid is expelled under relatively high velocity and pressure.

An impact member 428 is disposed in-line with and downstream of the exit orifice 426 such that the liquid is directed against the impact member 428 as part of the process for breaking the liquid stream into a spray pattern 432. In this regard, the impact member 428 may have various shapes or configurations that cause the relatively high velocity liquid stream from the exit orifice to break up into a spray pattern. In the illustrated embodiment, the impact member 428 is a generally cylindrical member 434 that defines a generally flat upper planar surface 436 against which the liquid stream 430 is directed, causing the stream to break apart into a radially directed pattern as illustrated in FIG. 7.

A spray forming chamber 429 is defined generally around the impact member 428. This forming chamber 429 is shaped so to further break up the pattern reflected from the planar surface 436 and to focus and direct the spray in an exit direction out of the delivery end of the spray forming mechanism 420, as indicated by the arrow lines in FIG. 7.

The spray forming mechanism 420 may also include restraining structure disposed radially inward of a point of flexure 406 of the resilient flap members 402 to contact and limit the degree of flexure of the flap members 402. In a particular embodiment, the restraining structure may be an end 438 of a generally cylindrical wall 440 that extends into the valve 400 and is radially inward of the inner circumferential wall 408 of the valve 400. The end 438 of the cylindrical wall 440 is disposed adjacent the flap members 402 radially inward of their respective points of flexure 406 and thus limits the degree of opening movement of the flap members 402 upon actuating the pump cylinder 340. This configuration ensures that the flap members 402 do not completely open and that the liquid pushed through the valve 400 upon pressurization of the pump chamber 322 is maintained at a sufficient pressure and velocity to eventually be converted into a spray in the spray forming mechanism 420. The cylindrical wall 440 may also define the chamber 422 disposed downstream of the valve, as in the illustrated embodiment.

In a particular embodiment, the restraining structure (i.e., the cylindrical wall 440 and end 438) is defined within a retaining member 442 that attaches to the delivery end of the pump cylinder 340 and serves to retain the valve mechanism within the delivery end of the pump cylinder. The retaining member 442 has an outer wall 452 with an annular space 450 defined between the cylindrical wall 440 for accommodating the walls 407, 408 and U-shape turn 409 of the valve member 400. The retaining member 442 releasably (or permanently) attaches to the delivery end of the pump cylinder 340 by any convenient engaging means, such as male protuberances 444 that frictionally engage within recesses (not illustrated) defined in the delivery end of the pump cylinder 340.

The spray forming chamber 429 described above may be defined by a cylindrical extension 431 of the retaining member 442, as illustrated in the figures.

The impact member 428 discussed above may also be formed integral with the retaining member 442, or be a separate component that releasably attaches to the retaining member 442. For example, referring to FIG. 9, the impact member 428 is a separate member having radial wings 452 that frictionally engage within notches 448 defined in the end surface of the cylindrical extension 431.

It should be appreciated that various configurations of retaining members 442, restraining structure 438, impact member 428, and the various chambers discussed above are within the scope and spirit of the invention.

So as not to draw an excessive vacuum within the reservoir 68, the reservoir may be further vented by various means. One preferred venting method as illustrated in the figures is to vent the top of the housing 14, for example by way of a conventional vent valve 130 disposed through the top surface of the housing 14. A suitable vent valve 130 is illustrated and described, for example, in U.S. Pat. No. 6,575,335 incorporated herein by reference. Preferably, the valve 130 is designed to seal an opening provided in the top surface of the housing 14 upon an overfill condition of the viscous liquid, or upon the housing 14 being overturned during shipment or the like. Once the dispenser is hung on a wall surface for subsequent use, the valve 130 unseats to vent the reservoir 68. It is also convenient to initially fill the dispenser 10 with a desired viscous liquid through the hole in the top of the housing 14 into which the valve 130 is subsequently inserted.

As mentioned, the pump mechanism is operated by a user depressing an actuator 30. The actuator 30 may be any member configured to move the pump cylinder 340. In one embodiment illustrated in the figures, the actuator 30 is defined by a panel member 32 that adds a distinctive aesthetically pleasing look to the housing 14. The panel member 32 includes side walls 34 having inwardly disposed protrusions that engage within correspondingly sized recesses provided in the sides 16 of the housing 14. A depression 33 may be defined in the front face of panel member 32 to indicate to a user the proper location for depressing the actuator. It should be appreciated that the actuator may take on any configuration or aesthetically pleasing shape.

The dispenser 10 according to the invention may also include an integrally formed mounting mechanism configured as an integral component of the housing 14. This mounting mechanism allows the dispenser 10 to be detachably connected with complimentary mounting structure, generally 58, provided on a wall surface 12 (FIG. 3). In one embodiment according to the invention, the mounting mechanism is defined as an integrally molded feature of the back side 18 of the dispenser 10. In the illustrated embodiment, a recess 50 is molded into the back side 18. The recess 50 is defined by generally vertical side walls 52. Engaging structure is provided along the side walls 52 for engaging against or with complimentary structure provided on the wall mounting structure 58, as discussed in greater detail below. In the illustrated embodiment, the engaging structure is defined by angled surfaces 56 defined along the vertical walls 52. The angled surfaces 56 engage against complimentary angled surfaces 62 defined on the wall mounting structure 58, as can be particularly seen in FIG. 3. In the illustrated embodiment, at least two angled surfaces 56 are provided and are separated by a section of vertical wall 52. The two angled surfaces 56 engage against angled surfaces 62 of the wall mounting structure 58. In order to attach the dispenser 10 to the wall mounting structure 58, the maintenance technician simply positions the dispenser 10 against the wall mounting structure 58 such that the angled surfaces 56 are vertically disposed between the corresponding angled surfaces 62 of the wall mounting structure. Then, the maintenance technician simply slides the dispenser 10 in a vertical direction so that the angled surfaces 56, 62 engage. In this interlocking configuration, the dispenser cannot be pulled away from the wall mounting structure 58. The double angled surface 56 configuration provided on each vertical wall 52 is particularly useful in that it provides an increased interlocking surface area of angled surfaces with relatively little vertical movement required between the dispenser 10 and the wall mounting structure 58 as compared to a single angled surface 56 having the same longitudinal surface area.

Once the dispenser 10 has been properly located on the wall mounting structure 58, it is desirable to include a securing device to indicate to the technician that the dispenser 10 has been properly positioned and to prevent removal of the dispenser 10 without a concerted effort. In the embodiment illustrated, the securing device comprises a protrusion 126 extending from the back side 18 of the housing within the recess 50. The protrusion 126 slides up a ramp surface 129 defined in the mounting structure 58 and snaps into a correspondingly sized divot 128 disposed adjacent to the ramp surface 129.

The wall mounting structure 58 may comprise any manner of suitable attaching structure. In the illustrated embodiment, the wall mounting structure 58 is defined by a plate member 60 that is attached to the wall surface 12, for example by screws, adhesives, or the like. The wall mounting structure 58 serves simply to provide an interlocking engagement device for the dispenser 10. It should be appreciated that any manner of interlocking engaging configurations may be provided for detachably connecting the dispenser 10 to complimentary wall structure provided on a supporting wall. For example, relatively simple bayonet type fasteners, spring loaded latches, and the like, may be provided in this regard. A desirable feature of the invention is that the entire dispenser 10 is disposable and, thus, relatively simple yet reliable engagement devices are preferred. It has been found that the double angled surface configuration as illustrated and described herein is particularly useful in this regard.

It may also be desired to provide means for the maintenance technician to determine the level of viscous liquid within the dispenser. In this regard, as discussed above, a portion of the housing 14 may be formed from a translucent or clear material. In the embodiment illustrated particularly in FIGS. 1-3, the entire back component 22 is formed from a translucent or clear material so that the service or maintenance technician can view the remaining liquid level from the side of the dispenser. In an alternative embodiment, a window of clear or translucent material may be provide anywhere in the housing 14, preferably near the bottom portion of the housing, to provide the maintenance technician with the capability of viewing inside the reservoir to determine the remaining amount of liquid therein.

It should be appreciated that the invention includes modifications and variations to the embodiments of the invention described herein.

What is claimed is:

1. A self contained liquid dispenser with a spray pump mechanism, comprising:

a housing defining an internal liquid reservoir, said housing including a front surface having an opening therethrough adjacent a bottom surface of said reservoir;

a horizontally disposed pump chamber fitted through said opening, said pump chamber extending into said reservoir and having a back end open to said reservoir and a front end open to the outside of said housing;

a pump cylinder slidably disposed and retained in said chamber, said pump cylinder having a delivery end extending out of said pump chamber and a delivery channel defined therethrough, said pump cylinder movable within said pump chamber from a rest position to a pressurizing position;

an actuator configured with said delivery end so that said pump cylinder is operable from outside of said housing;

a valve mechanism disposed in said delivery end, said valve mechanism comprising a plurality of flexible flap members defining an opening therethrough in an open configuration of said valve mechanism and sealed against each other in a closed configuration of said valve mechanism;

a spray forming mechanism disposed downstream of said valve mechanism to contact and convert a stream of liquid forced through said valve mechanism upon actuation of said actuator into a spray pattern.

2. The dispenser as in claim 1, wherein said spay forming mechanism comprises a chamber defining an exit orifice through which liquid from said valve mechanism is directed, and an impact member disposed in-line with and downstream of said exit orifice, said impact member causing a relatively high velocity liquid stream from said exit orifice to break up into a spray pattern.

3. The dispenser as in claim 2, wherein said impact member is disposed within a spray forming chamber.

4. The dispenser as in claim 2, wherein said impact member comprises a generally flat planar upper surface disposed opposite and spaced from said exit orifice.

5. The dispenser as in claim 1, wherein said valve mechanism comprises a bifurcating valve, said flexible flap members extending radially inward from one end of a flexible circumferential wall so as to flex towards said wall to open said valve mechanism, and further comprising restraining structure disposed radially inward of said circumferential wall to contact and limit the degree of flexure of said flap members.

6. The dispenser as in claim 5, wherein said restraining structure comprises a generally cylindrical wall member extending into said bifurcating valve towards said flap members.

7. The dispenser as in claim 6, wherein said cylindrical wall member further defines a chamber defining an exit orifice through which liquid forced through said flexible flaps is directed.

8. The dispenser as in claim 7, further comprising an impact member disposed in-line with and downstream of said exit orifice, said impact member causing a relatively high velocity liquid stream from said exit orifice to break up into a spray pattern.

9. The dispenser as in claim 8, wherein said restraining structure is defined within a retaining member that attaches to said delivery end, and said impact member comprising a removable component of said retaining member.

10. A self contained liquid dispenser with a spray pump mechanism, comprising:

a housing defining an internal liquid reservoir a pump chamber extending into said reservoir and having a back end open to said reservoir and a front end open to the outside of said housing;

a pump cylinder slidably disposed and retained in said chamber, said pump cylinder having a delivery end extending out of said pump chamber and a delivery channel defined therethrough, said pump cylinder movable within said pump chamber from a rest position to a pressurizing position;

a valve mechanism disposed in said delivery end, said valve mechanism comprising a plurality of flexible flap members defining an opening therethrough in an open configuration of said valve mechanism and sealed against each other in a closed configuration of said valve mechanism;

a spray forming mechanism disposed downstream of said valve mechanism to contact and convert a stream of liquid forced through said valve mechanism into a spray pattern.

11. The dispenser as in claim 10, further comprising a retaining member attachable to said delivery end to secure said valve mechanism within said delivery end, said retaining member having said spray forming mechanism configured therein.

12. The dispenser as in claim 11 wherein said retaining member comprises a diverging chamber defining an exit orifice through which liquid from said valve mechanism is directed, and an impact member disposed in-line with and downstream of said exit orifice, said impact member causing a relatively high velocity liquid stream from said exit orifice to break up into a spray pattern.

13. The dispenser as in claim 12, wherein said impact member is disposed within a spray forming chamber defined in said retaining member.

14. The dispenser as in claim 13, wherein said impact member comprises a generally flat planar upper surface disposed opposite and spaced from said exit orifice.

15. The dispenser as in claim 13, wherein said impact member is removable from said retaining member.

16. The dispenser as in claim 11, wherein said valve mechanism comprises a bifurcating valve, said flexible flap members extending radially inward from one end of a flexible circumferential wall so as to flex and open said valve mechanism, and said retaining member further comprising a restraining wall disposed radially inward of said circumferential wall to contact and limit the degree of opening flexure of said flap members.

17. The dispenser as in claim 16, wherein said restraining wall comprises a generally cylindrical wall member extending into said bifurcating valve towards said flap members.

18. The dispenser as in 17, wherein said cylindrical wall member defines a chamber defining an exit orifice through which liquid from said valve mechanism is directed, and further comprising an impact member disposed in-line with and downstream of said exit orifice, said impact member causing a relatively high velocity liquid stream from said exit orifice to break up into a spray pattern.

19. The dispenser as in claim 10, further comprising an actuator configured with said delivery end of said pump cylinder to move said pump cylinder from said rest position to said pressurizing position from outside of said housing.

20. The dispenser as in claim 10, comprising an insert member fitted into an opening in said housing, said pump chamber defined within said insert member, said insert member having a back end open to said reservoir and a front end open to the outside of said housing, said insert member having a front end attached to said housing.

21. The dispenser as in claim 20, wherein said pump cylinder comprises a first component having a first channel defined therethrough, and a second component fitted into said first component and having a second channel defined therethrough that is axially aligned with said first channel, said first and second channels defining said delivery channel through said pump cylinder.

22. The dispenser as in claim 21, further comprising at least one radially extending seal on each of said first and second components, said seals slidable along an inner wall of said pump chamber as said pump cylinder moves within said pump chamber.

* * * * *